US005990854A

United States Patent [19]

Weber

[11] Patent Number: 5,990,854

[45] Date of Patent: Nov. 23, 1999

[54] AC PLASMA PANEL WITH SYSTEM FOR PREVENTING HIGH VOLTAGE BUILDUP

[75] Inventor: Larry F. Weber, New Paltz, N.Y.

[73] Assignee: Plasmaco, Inc., Highland, N.Y.

[21] Appl. No.: 08/383,705

[22] Filed: Feb. 1, 1995

Related U.S. Application Data

[63] Continuation of application No. 08/101,572, Aug. 3, 1993, abandoned.

[51] Int. Cl.[6] ..... G09G 3/28

[52] U.S. Cl. ..... 345/66; 345/58; 345/60; 345/209; 315/111.31; 315/326

[58] Field of Search ..... 345/60–71, 58, 345/209; 315/111.31, 326, 340; 313/553

[56] References Cited

U.S. PATENT DOCUMENTS

| | | | |
|---|---|---|---|
| 3,559,190 | 1/1971 | Bitzer et al. | 340/173 |
| 3,666,981 | 5/1972 | Lay | 345/71 X |
| 4,079,370 | 3/1978 | Mikoshiba et al. | 345/66 |
| 4,591,847 | 5/1986 | Criscimagna et al. | 345/68 |
| 4,772,884 | 9/1988 | Weber et al. | 340/776 |

FOREIGN PATENT DOCUMENTS

| | | | |
|---|---|---|---|
| 2504730 | 9/1975 | Germany | 345/66 |

OTHER PUBLICATIONS

"Improvement of Luminance and Luminous Efficiency of Surface–Discharge Color ac PDP", T. Shinoda et al., SID 91 Digest, pp. 724–727.

*Primary Examiner*—Bipin H. Shalwala
*Assistant Examiner*—Kent Chang
*Attorney, Agent, or Firm*—Ohlandt, Greeley, Ruggiero & Perle

[57] ABSTRACT

An AC plasma panel display includes front and back panels that respectively support a first parallel electrode pattern and a second orthogonally oriented, parallel electrode pattern. The electrode patterns define a display area and both patterns are covered by dielectric layers. A dischargeable gas is positioned between the dielectric layers in the known manner. Driver circuitry is coupled to both electrode patterns for creating a spatially continuous gas discharge along at least one continuous electrode of one electrode pattern and across the entire display area. The driver circuitry scans the spatially continuous gas discharge across remaining parallel electrodes of the one electrode pattern so as to scan the entire display area. A further electrode is in DC conductive communication with the gas and is positioned outside of the display area but in contact with the spatially continuous gas discharge during its scanning action. The electrode provides a capacitive structure which prevents a build-up of an excessive static charge on the dielectric layers and thereby prevents dielectric breakdown.

12 Claims, 4 Drawing Sheets

| | FRAME 1 | | | | | | | | | | FRAME 2 | | |
|---|---|---|---|---|---|---|---|---|---|---|---|---|---|
| | t1 | t2 | t3 | t4 | t5 | t6 | t7 | t8 | t9 | t10 | t11 | t12 | ••• |
| TOP EDGE | – | – | – | – | – | – | – | – | – | – | – – | – – | ••• |
| ROW 1 | ++ | – | – | – | – | – | – | – | – | – | + | – – | ••• |
| ROW 2 | – | +++ | – | – | – | – | – | – | – | – | – – | ++ | ••• |
| ROW 3 | | – | ++++ | – | – | – | – | – | – | – | – | – – | |
| ROW 4 | | | – | +++++ | | | | | | | | | |
| ROW 5 | | | | – | ++++ | | | | | | | | |
| ROW 6 | | | | | | ++++ | | | | | | | |
| ROW 7 | | | | | | | ++++ | | | | | | |
| ROW 8 | | | | | | | | ++++ | | | | | |
| ROW 9 | | | | | | | | | ++++ | | | | |
| ROW 10 | | | | | | | | | | ++++ | ++++ | ++++ | |

FIG.3

AC PLASMA PANEL WITH SYSTEM FOR PREVENTING HIGH VOLTAGE BUILDUP

This is a continuation of application Ser. No. 08/101,572 filed on Aug. 3, 1993, now abandoned.

FIELD OF THE INVENTION

This invention relates to gas discharge (i.e. "plasma") panels, and more particularly, to AC operated gas discharge panels which include means for prevention of high voltage static charge buildup.

BACKGROUND OF THE INVENTION

AC plasma display panels or gas discharge panels are well known in the art and generally comprise a pair of glass substrates respectively supporting column and row electrode patterns. The electrode patterns are coated with dielectric layers and are disposed in parallel spaced relation to define a gap therebetween. The substrates are arranged such that the electrode patterns are disposed in orthogonal relation and thereby define points of electrode intersection which, in turn, define discharge cells. A dischargeable gas is positioned in the gap between the dielectric layers and may be selectively discharged by appropriate energization of intersecting electrodes.

Such panels operate with AC voltages and provide a write voltage which exceeds the firing voltage of the gas at a given discharge "pixel cell" as defined by selected, intersecting, column and row electrodes. A discharge at a selected pixel cell can be continuously "sustained" by applying an alternating polarity sustain voltage, which by itself is insufficient to initiate a discharge. The sustain action relies upon wall charges which are generated on the dielectric layers and cooperate with the applied sustain signal to exceed the gas breakdown voltage.

Early versions of the AC plasma display panel applied both addressing and sustain signals to common electrodes (see U.S. Pat. No. 3,559,190 to Bitzer et al.). Later, improved AC plasma displays have separated the sustain and address circuitry to achieve greater flexibility in operation and lower drive circuit costs (see U.S. Pat. No. 4,772,884 to Weber et al.). In most AC plasma display structures, all electrodes within a display area of the panel structure are covered by the dielectric layer, thereby enabling wall charge accumulation and preventing arc-over which could occur if conductors were directly exposed to the ionizable gas.

DC-operated plasma display panels employ DC electrodes that are in direct contact with the gas, but employ current limiting devices in the drive circuitry to prevent excessive current flow when the gas discharges. To confine the discharge area within a DC plasma display panel, dielectric separators are positioned between the pixel cells and prevent the spread of the ionized gas. In AC plasma panels, such separators are not required.

DC electrodes have also been used in AC plasma panel structures. Engineers at the Fujitsu Corporation have developed a panel that has dielectric-covered AC electrodes on one substrate and orthogonally oriented, metal DC electrodes on the other substrate. This panel is described in a paper entitled "Improvement of Luminance and Luminous Efficiency of Surface-Discharge Color AC PDP" by Shinoda et al., Society for Information Display, International Symposium, Digest of Technical Papers, vol. 22, pages 724–727, May 6–10, 1991. In the Shinoda et al. panel, AC electrodes on the front glass plate were energized with the usual AC sustain signal and DC electrodes on the rear glass substrate were used only for addressing.

It has recently been found that AC plasma display panels exhibit a reliability problem that is manifested by an irreversible breakdown of the thick film dielectric layer over the electrode structures. The dielectric layer is the fundamental insulating layer that prevents destructive arc discharge in the panel. Referring to FIG. 1, a cross-section of a prior art AC plasma panel is shown and includes glass substrates 10 and 12 that enclose a dischargeable gas 14. Row electrodes 16 reside on the lower surface of glass substrate 10 and column electrodes 18 (only one is shown), reside on the upper surface of glass substrate 12. Electrodes 16 and 18 are each covered by dielectric layers 20 and 22 which may, in turn, be covered by a further dielectric MgO overcoat (not shown).

Dielectric layers 20 and 22 are normally designed to withstand voltages of at least 500 volts. Typically used sustain pulses are approximately 100 volts and, when added to a maximum value of 100 volts of wall potential which appear on the walls of dielectric layers 20, 22, result in a maximum potential across both dielectric layers 20 and 22 of approximately 200 volts (or 100 volts across each dielectric). Thus the 500 volt breakdown strength for each dielectric layer offers a significant safety factor under normal operation. Nevertheless, it has been found that under certain circumstances, dielectric layers 20 and 22 experience catastrophic breakdown, with a resultant arcing between electrodes 16 and 18. Once this breakdown has occurred, the panel is permanently damaged and in the neighborhood of the damaged dielectric, will not function properly. The cause of such dielectric breakdown has heretofore been thought to result from dielectric abnormalities or deficiencies. As will be apparent from the below described invention, the Applicant has found that the cause of the dielectric breakdown is entirely different than heretofore understood.

Accordingly, it is an object of this invention to provide an improved method for operating an AC plasma panel which prevents arc breakdown of dielectric layers covering panel electrodes.

It is yet another object of this invention to provide an improved AC plasma panel structure which prevents conditions from occurring within the AC plasma panel that lead to dielectric layer breakdown.

SUMMARY OF THE INVENTION

An AC plasma display includes front and back panels that respectively support a first parallel electrode pattern and a second orthogonally oriented, parallel electrode pattern. The electrode patterns define a display area and both patterns are covered by dielectric layers. A dischargeable gas is positioned between the dielectric layers in the known manner. Driver circuitry is coupled to both electrode patterns for creating a spatially continuous gas discharge along at least one continuous electrode of one electrode pattern and across the entire display area. The driver circuitry scans the spatially continuous gas discharge across remaining parallel electrodes of the one electrode pattern so as to scan the entire display area. A further electrode is positioned in DC conductive communication with the gas and outside of the display area, but in contact with the spatially continuous gas discharge during its scanning action. The electrode provides a capacitive structure which prevents a build-up of excessive static charge on the dielectric layers and thereby prevents dielectric breakdown.

DESCRIPTION OF THE DRAWINGS

FIG. 3 is a chart illustrating the build-up of charge which occurs as a result of the operation of the plasma panel shown in FIGS. 1 and 2;

DETAILED DESCRIPTION OF THE INVENTION

MECHANISM OF OVER-VOLTAGE PRODUCTION

The above-described dielectric layer breakdown has been found to be caused by a scanning action of the discharge created when an AC plasma display is operated in a typical raster-scan video mode. In such mode, frames of image information are sequentially scanned into the display. Each frame starts with the initial addressing of a top row of pixel cells, followed by addressing of a next row down and so on until the final bottom row of pixel cells is addressed. This scan action is then initiated again for the next frame by addressing the top row of pixel cells, etc.

The sequential addressing operation has been found to move considerable charge from the "top" of the panel towards the "bottom" of the panel. This movement of charge has been found to cause the panel to act much like a Van de Graaf generator. Such a generator forms very high voltages between two metal spheres by means of a moving insulating belt that transports charge from one sphere to the other. Such action can produce hundreds of thousands of volts of static charge, with the maximum voltage charge being limited by the breakdown strength of the air or insulating means used between the spheres. In sequentially addressed AC plasma displays, the top and bottom substrate of the display have been found to act like Van de Graaf surfaces and the discharge activity that moves from the top to the bottom of the display is similar to the moving belt of a Van de Graaf generator.

More specifically, when a gas discharge occurs, there is a large population of negative electrons and positive ions formed in the gas volume. The charges drift and diffuse in the gas volume until they eventually recombine with each other or collect on the dielectric walls. Since electrons are much lighter than ions, the electrons move much faster in the gas and thus, have a tendency to move away from the discharge area faster than the ions.

Figure 1:
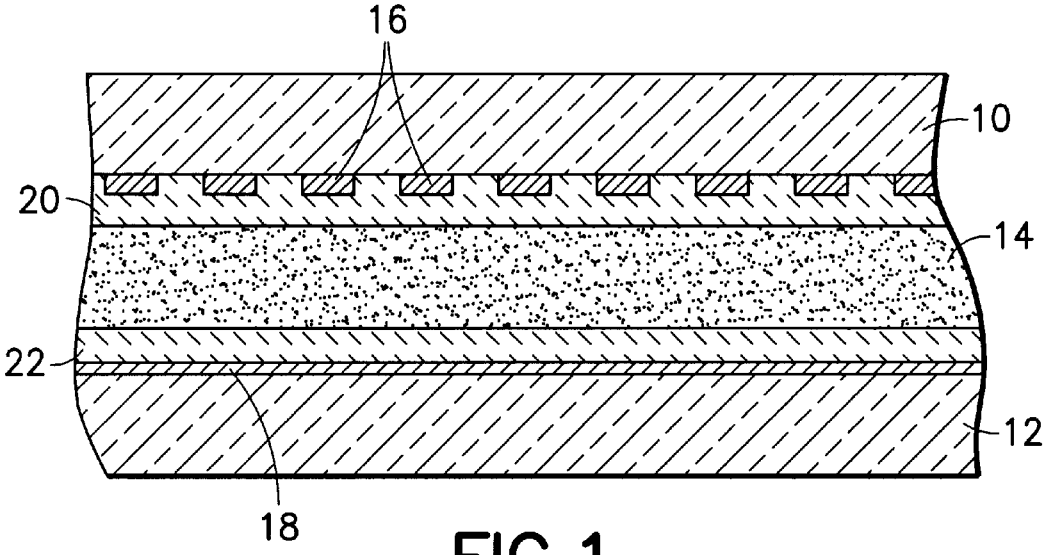
FIG. 1 PRIOR ART
FIG. 1 is a sectional view of a prior art AC plasma panel.
Figure 2:
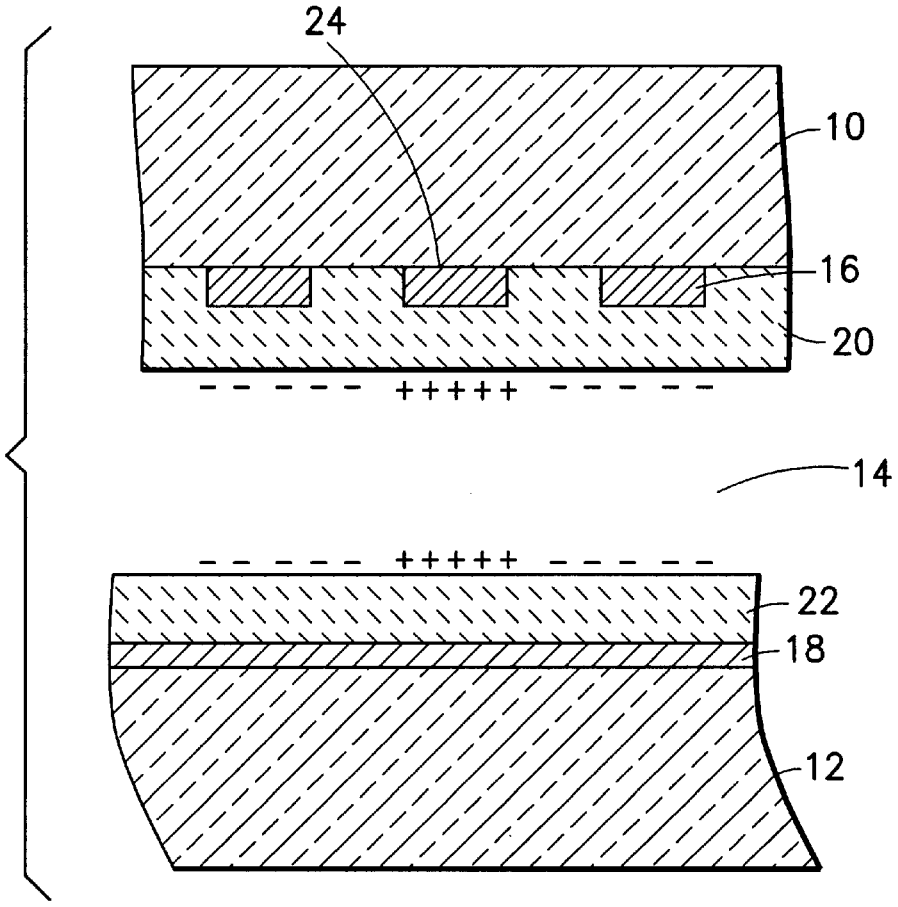
FIG. 2 PRIOR ART
FIG. 2 is an enlarged view of a section of FIG. 1 showing the charge build-ups that occur on dielectric layers covering orthogonal electrode patterns.

FIG. 2 shows the state of charge on the walls of dielectric layers 20 and 22 after a gas discharge has subsided. For the purposes of this description, the illustrated wall charge distribution is chosen for a case where the wall charges on top dielectric layer 20 are equal to the wall charges on bottom dielectric layer 22. It is further assumed that appropriate potentials are applied to the column and row electrodes so as to only cause a discharge at the intersection between row electrode 24 and column electrode 18. At row electrodes on either side of row electrode 24, no discharge occurs.

The principle to be observed from FIG. 2 is that after a discharge has abated, the surfaces of dielectric layers 20 and 22, where the discharge is most intense (i.e., directly under electrode 24), become positively charged. The surface areas of dielectric layers 20 and 22 away from the most intense area of discharge become negatively charged. This is the result of the lighter electrons moving fastest and departing from the central-most intense area of discharge, leaving the heavier positive ions to collect on the surface of dielectric layers 20 and 22 that are closest to the most intense discharge regions. While a majority of the charge distribution variation occurs in a region closest to the discharging cell area beneath electrode 24, there is still an amount of negative charge that collects on adjacent, non-discharging cells. This small amount of charge has been found to be left behind as the address discharge is sequenced from one row to a next row of pixel cells. This action forms the basis of the mechanism of high voltage build-up.

Referring now to FIG. 3, a diagram is shown that illustrates the movement of charge from the top to the bottom of an AC plasma display that is scanned in a raster-scan mode. Each row corresponds to a differing "horizontal" row electrode and each column corresponds to a different scan time. For exemplary purposes, a panel with 10 row electrodes has been chosen, however, those skilled in the art will realize that an actual panel will have hundreds and sometimes thousands of rows. Each time step t1–tn corresponds to a new addressing event on a sequentially scanned row electrode.

In many AC plasma displays, a continuous discharge region across the entire width of the panel will occur when all pixel cell cells in a row are initially written to the ON state, which operation is immediately followed by a series of sustain signals. The ON pixel cells are then selectively erased to enter desired data. In AC plasma displays which exhibit independent sustain and address electrodes, a continuous discharge across the entire width of the panel will occur when two rows of pixel cell cells are simultaneously written and are then subsequently, selectively erased to enable entry of desired data. In either case, an addressed row sees a spatially continuous discharge region spanning the entire width of a panel's display area.

A scanning sequence commences at time t1 when a discharge is created along the electrode (or electrodes) comprising row one. The strong discharge activity causes the dielectric along the row one electrode to be positively charged and regions vertically above and below the electrode to become negatively charged. This is indicated in FIG. 3 by the top edge of the panel becoming somewhat negatively charged, the region immediately over row one becoming positively charged, and a small negative charge migrating to the electrode at row two. Note that because the interior walls of a plasma panel are fully insulated from the outside world, that charge is fully conserved. In other words, at any given time, the total number of positive charges in the panel must equal the total number of negative charges so that there is always a balance maintained. It will be found that such a balance is illustrated in FIG. 3.

At time t2, the address scan moves to the electrode of row two and resulting row discharge activity causes the dielectric over the row two electrode to become positively charged and regions spatially distant to become negatively charged. Note that because the discharge activity has moved from the row one electrode to the row two electrode, that the negative charge deposited on the top edge dielectric at time t1 remains there during t2, and for subsequent times.

It is to be appreciated that as the sequential addressing operation causes the discharge region to move down the rows of the AC plasma display, that the discharge area no longer communicates with far above regions where charge has been left behind. The charge that is left behind will always be negative because the regions away from the central discharge always are negatively charged. Note that at time t2, the row two electrode has three positive charges which is one more than a row one electrode had at t1. This extra positive charge is necessary for charge conservation due to the negative charge that was left behind at the top edge during t1.

At times t3 and t4, the address scan continues on the row three and four electrodes. More negative charge is left behind and the dielectric over the discharging row electrode becomes more and more positive. As the dielectric surfaces at the site of the discharges become more positive, a stronger electric field is set up between the central region of the discharge area and the regions away therefrom. The stronger electric field retards the flow of electrons to the outer regions because the electrons are attracted to the more positive central discharge. Thus as the central discharge becomes more and more positive, there are fewer and fewer electrons that flow to the outer regions of the discharge. This is illustrated in FIG. 3 for times t5–t10 where no negative charge is left behind because of the high level of positive charge in the central discharge area.

For the illustrative purposes only, FIG. 3 shows an abrupt change in the amount of negative charge left behind between times t4 and t5. In actual operation, the decrease in the amount of negative charge left behind is gradual and follows a gradual build-up of the positive charge in the central discharge region. Note also that for times t5–t10 that the amount of charge is a constant level of four positive charges because there is no longer any negative charge left behind.

At time t10, the address discharge reaches the bottom of the display. At time t11, the sequence moves to the next frame and the top electrode is again discharged. Note that when the scan returns to the top of the panel, that a significant positive charge is left on the dielectric surface covering the row 10 electrode. This positive charge will remain on the row 10 electrode for subsequent times because there is no discharge activity near that row electrode.

The net result of the first frame scan is that a significant amount of positive charge has been transferred to the bottom of AC plasma display and a significant amount of negative charge has been left at the top of the display. During subsequent frames, the charges generated add to those previously left behind during the initial frame. The charge build-up continues until it is limited by some mechanism that enables the large amount of positive charge on the bottom to leak back and neutralize the negative charge at the top. Without such a charge leakage mechanism, the voltage can build to a very high level. Experiments with Langmuir probes in AC plasma displays have shown that voltages on the order of plus 1,000 volts can be measured at the bottom of the display and on the order of −1,000 volts at the top of the display. The voltage near the center of the display was experimentally measured to be near 0 volts. Such high voltages are well beyond the breakdown limit of the dielectric layers and enable destructive breakdown to occur. Applicant is unaware of any understanding in the prior art of this breakdown mechanism.

Prior to describing a preferred embodiment of the invention which enables prevention of the high voltage build-up, other less-preferred methods will be briefly considered. The conductivity of the ionizable gas can be employed to create a discharge path. For instance, where all or a substantial majority of the pixel cells are in the same ON state, the gas will enable the residual charges to rebalance. However, this requires a special mode of operation which the user cannot be depended upon to reproduce. Further, if the user operates the plasma display so as to create an all-OFF pixel cell condition, the high voltage build-up will re-occur.

Another method for reducing destructive voltage build-up would be to use a dielectric material that is slightly resistive so that the charge will slowly leak off. While such a resistive dielectric will work in principal, it is difficult to manufacture such a dielectric that will conduct the necessary small amounts of charge and, in addition, withstand a 500 volt breakdown strength necessary for safe, practical AC plasma display operation. Most weak conduction mechanisms in dielectrics depend upon ion drift through the dielectric. Such a drift can result in localized accumulation of ions which generate very large space charge fields and cause destructive dielectric breakdown.

It is also possible to employ a slightly conductive surface film to enable charge leakage. Such a film would be deposited on the inside surfaces of either or both dielectric layers and would require sufficient conductivity to prevent destructive high voltage build-up. At the same time the film could not be so conductive that it leaks away the wall charges that give the pixel cells their memory characteristic. Such materials, that are also compatible with plasma panel manufacturing processes, are not known.

PREFERRED EMBODIMENTS

A preferred embodiment for preventing high voltage build-up is to place a DC electrode (or electrodes) in direct contact with the ionizable gas. Such an electrode must be able to conduct small DC currents from the gas discharge and therefore it cannot be covered by a completely insulating dielectric. There are number of places within a DC panel where such a DC electrode could be placed and still maintain the operational characteristics of the AC plasma panel display. However, it is important when such a DC electrode is introduced into the panel that it does not cause arc breakdown or otherwise degrade the performance of the panel or present additional difficulties of manufacture.

The DC electrode (or electrodes) is preferably placed outside the display area of the plasma display and thus, does not effect the operation of the basic AC plasma operation. Such DC electrode or electrodes can be fabricated at the same time and on the same surface that the column electrodes are fabricated. When those electrodes are covered with the dielectric surface, the dielectric over the DC electrode(s) can be etched away (or masked-off) thereby exposing them to contact with the gas. To assure longevity of such DC electrodes, they may be subsequently covered by a weakly conductive oxide (e.g. MgO). That prevents sputter damage while allowing DC electrical contact between the electrode and the gas.

Figure 4:
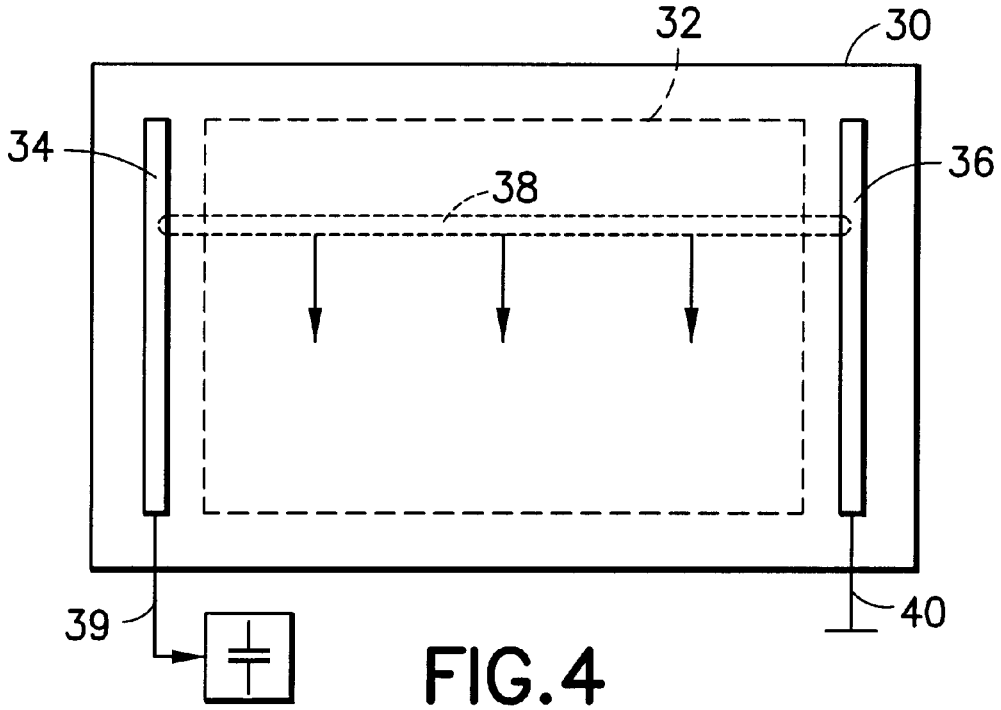
FIG. 4 is a schematic plan view of an AC plasma panel that incorporates a preferred embodiment of the invention hereof.

In FIG. 4, a plasma panel 30 includes a display area 32 wherein orthogonal electrode structures, such as those described above, are present (not shown). A pair of DC electrodes 34 and 36 are positioned exterior to display area 32 and orthogonally to the image scan direction. If panel 30 is scanned from top to bottom, then positive charge will build up on the bottom and negative charge will build up on the top. Vertical DC electrodes 34 and 36, in combination with an operation of panel 30 that causes a spatially continuous discharge region 38 to scan vertically the display area 32, prevents such a charge build-up. DC electrodes 34 and 36 act as large capacitances which drain off accumulated charge and during each scan operation and enable the positive and negative charges to recombine and neutralize each other.

Spatially continuous discharge region 38 enables conduction along the horizontal direction for resident charge at every pixel cell along a row. It is preferred that the row drive circuitry create a pulsed gas discharge along all pixel cells of a row such the this conductive discharge provides a continuous conduction path to DC electrodes 34 and 36. Discharge region 38 must be conductive and spatially continuous so that all pixel cells along a row have a continuous DC conduction path to an adjacent DC electrode.

If discharge region 38 is allowed to scan along the panel from one row to the next in much the same way as a typical raster scan, then after one complete frame scan, every pixel cell in the panel will experience a conductive path to a DC electrode.

Discharge region 38 may take the form of a normal address discharge for the display. As indicated above, addressing of a display in a scan mode frequently takes the form of first writing all pixel cells in a row, allowing a small number of stabilizing sustain discharges, and then selectively erasing the pixel cells of that row in order to input information. In such a case, the write operation places all of the pixel cells along the selected row in the ON state. During subsequent stabilizing sustain discharges, all of the pixel cells in the selected row are discharged and thereby create a continuous, conductive, discharge region 38 that can conduct charge from all pixel cells in the row to DC electrodes 34 and 36. Thus a normal addressing operation provides the required spatially continuous conductive gas discharge region 38. Since such action scans every row of the panel, there is no need for any special extra row select pulses to provide the spatially continuous discharge region 38.

In the independent sustain and address structure as described in U.S. Pat. No. 4,772,884, the write two pixel cell rows operation is often employed. Such action also may be utilized to create the spatially continuous conductive gas discharge region 38.

While FIG. 4 shows a pair of DC electrodes 34 and 36 on either side of display area 32, only one such electrode is needed. However, the two electrodes provide for an extra charge conduction path and provide redundancy in the case one DC electrode is defective.

DC electrodes 34 and 36 are configured to act as capacitances to store the excess charge build-up during each scan of continuous discharge region 38. Each DC electrode acts like a charge bucket that stores positive charge from the bottom of AC plasma panel 30 (which positive charge is deposited when discharge region 38 is at the bottom of panel 30). The positive charge is then balanced out by the negative charge found when discharge region 38 returns to the top of the panel. If the capacitances of DC electrodes 34 and 36 are insufficient, then the rate of charge build-up in the panel may be greater than the charge conduction rate through the DC electrodes, and a destructive high voltage build-up may still occur. If the charge storage capacity of DC electrodes 34 and 36 cannot be made sufficiently large, a solution is to provide electrical connections 39 and 40 to external capacitances or capacitive circuits (e.g. 39) that increase the charge storage capability.

Figure 5:
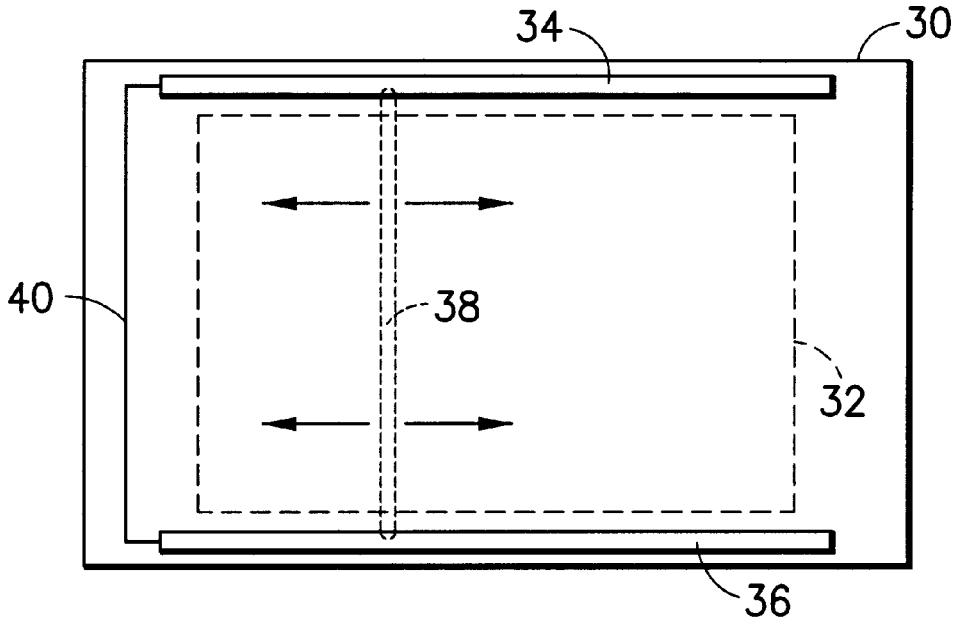
FIG. 5 is a schematic plan view of an AC plasma panel that incorporates a further embodiment of the invention hereof.

Referring to FIG. 5, a further embodiment of the invention is illustrated wherein DC electrodes 34 and 36 are placed horizontally within AC plasma panel 30 but outside of display area 32. If the addressing operation scans in the normal way (from the top of the display to the bottom), then DC electrode 34 would become negatively charged and DC electrode 36 would become positively charged. An electrical connection 40 therebetween will enable the neutralization of charge states on both DC electrodes.

Thus, FIG. 5 illustrates the case where the scan of spatially continuous discharge region 38 occurs from either right to left or left to right within display area 32. However, it is to be recited that address scanning continues in the normal top to bottom mode (in a direction othrogonal to the scan of region 38).

DC electrodes 34 and 36 shown in FIGS. 4 and 5 must not be placed so close to display area 32 as to cause undesirable discharges that cause pixel cells to function improperly.

Also, DC electrodes 34 and 36 may be much wider than row/column electrodes and if positioned within the normal viewing area, may be cosmetically unattractive. Moving DC electrodes 34 and 36 away from display area 32 will reduce the possibility for undesirable affects upon pixel cells within display area 32, but may have the effect of creating a discontinuity in the spatially continuous nature of gas discharge region 38. Such a discontinuity would allow a voltage build-up in the display area until it would be large enough to cause a large discharge that could bridge the gap between display area 32 and a DC electrode. Such a large discharge would likely have the effect of causing a misaddressing of a large number of pixel cells in the display area.

Figure 6:
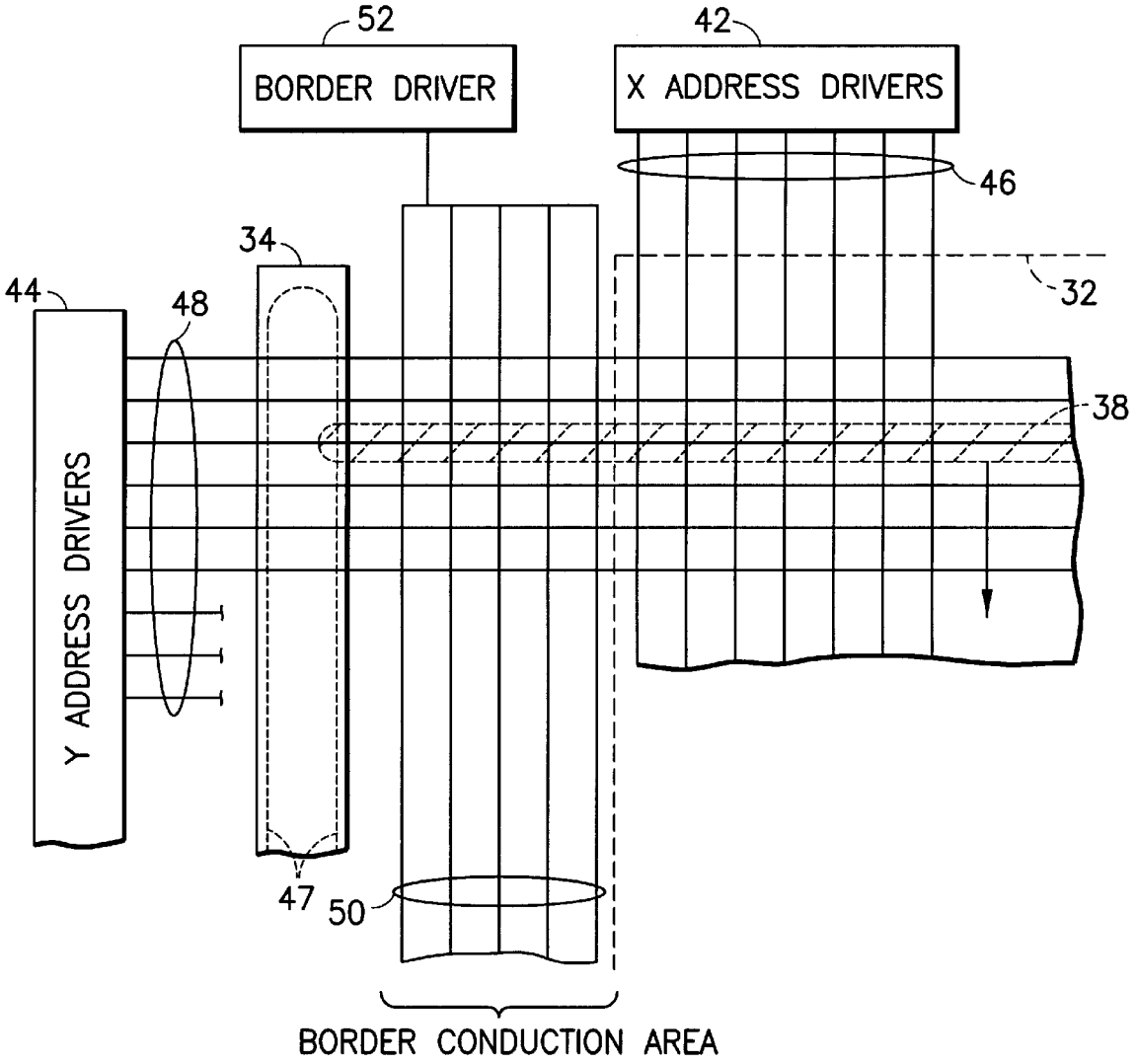
FIG. 6 is an expanded view of a portion of the AC plasma panel of FIG. 4, showing specific circuitry for prevention of charge buildup within the AC plasma panel.

The above affects can be avoided by the use of a border conduction area such as is illustrated in FIG. 6. FIG. 6 is an expanded view of the upper left corner of FIG. 4. X and Y address drivers 42 and 44 engage X and Y electrode groups 46 and 48, respectively. Y address drivers 44 and Y electrodes 48 reside on the rear substrate whereas X address drivers 42, X electrodes 46 and DC electrode 34 reside on the front substrate. Dotted line 47 indicates where the dielectric layer has been etched (or masked) to expose DC electrode 34. A plurality of border electrodes 50 are placed in the border conduction area and act to support spatially continuous discharge region 38 while not disturbing action of the pixel cells in display area 32.

Border electrodes 50 must not be allowed to create discharge sites that can be sustained in the ON state and appear to be the same as ON pixels in display area 32 (thereby creating an undesirable visual artifact). Border electrodes 50 are physically similar to X electrodes 46 and are positioned between X electrodes 46 and DC electrode 34 to enable a spatially continuous discharge region 38 to occur along a selected Y electrode 48.

Border electrodes 50 are connected to a border driver circuit 52 that enables the occurrence of a discharge but does not allow a sustain action. Border driver 52 applies a drive potential to border electrodes 50 such that when an address voltage is applied to a Y electrode 48, a spatially continuous discharge will occur at the intersection of the border electrodes 50 and the selected Y electrode 48. During a subsequent sustain time, border driver circuit 52 either applies a potential that opposes a sustain potential applied to Y electrodes 48 or, in the case where the sustain potential is applied equally between X and Y electrodes, maintains border electrodes 50 at a reference potential so as to prevent discharges upon application of a ½ sustain to a Y address electrode 48. Such action assures the continued existence of a spatially continuous discharge region 38, and prevents the action of DC electrode 34 from affecting pixel cell operations.

It should be understood that the foregoing description is only illustrative of the invention. Various alternatives and modifications can be devised by those skilled in the art without departing from the invention. For instance, while DC electrodes 34 and 36 have been described as high conductivity metals, they may also be fabricated as resistive elements or other partially conductive materials. Further, while the invention has been described in the context of a double substrate AC Plasma display, it is equally applicable to the single substrate configuration. Accordingly, the present invention is intended to embrace all such alternatives, modifications and variances which fall within the scope of the appended claims.

What is claimed is:

1. An AC plasma display comprising:

front and back substrates forming an enclosed volume;

a first parallel electrode pattern and a second, parallel electrode pattern within said volume, said first electrode pattern and second electrode pattern positioned within a display area;

dielectric layers covering both electrode patterns;

a dischargeable gas in said volume;

driver means coupled to said first and second electrode patterns for creating a spatially continuous gas discharge that extends along at least one electrode of one said electrode pattern and across said display area, said driver means energizing additional electrodes within said one electrode pattern to cause a scanning of said spatially continuous gas discharge region across said additional electrodes; and DC electrode means in direct electrical contact with said dischargeable gas and positioned outside of said display area, but in contact with said spatially continuous gas discharge region during said scanning, said DC electrode means acting as a capacitive reservoir for surface charge on said dielectric layers within said display area, said surface charge transferred to said DC electrode means by scanning of and conduction through said spatially continuous gas discharge region.

2. The AC plasma display as recited in claim 1 wherein said first parallel electrode pattern defines a series of electrodes disposed horizontally when said plasma display is mounted for user viewing, and said second parallel electrode pattern defines a series of electrodes disposed vertically when said plasma display is mounted for said user viewing, said DC electrode means positioned parallel to said vertically disposed electrodes.

3. The AC plasma display as recited in claim 2 wherein said driver means causes said continuous gas discharge region to scan from a top-most electrode of said horizontally disposed electrodes to a bottom-most electrode of said horizontally disposed electrodes.

4. The AC plasma display as recited in claim 3, wherein said DC electrode means comprise at least a pair of DC electrodes, one said DC electrode positioned on one side of said display area and disposed parallel to said vertically disposed electrodes and another DC electrode positioned on an opposing side of said display area and disposed parallel to said vertically disposed electrodes, both said DC electrodes in conductive communication with said spatially continuous gas discharge region.

5. The AC plasma display as recited in claim 2 wherein said driver means causes said spatially continuous gas discharge region to scan from a side-most electrode of said vertically disposed electrodes to an oppositely disposed side-most electrode of said vertically disposed electrodes.

6. The AC plasma display as recited in claim 5, wherein said DC electrode means comprise at least a pair of DC electrodes, one said DC electrode disposed above said display area when viewed by a user and parallel to said horizontally disposed electrodes and another DC electrode positioned below said display area when viewed by a user and parallel to said horizontally disposed electrodes, both said DC electrodes in conductive communication with said substantially continuous gas discharge region.

7. The AC plasma display as recited in claim 1 wherein said DC electrode means exhibits a larger electrode surface area than any individual electrode comprising said first electrode pattern and said second electrode pattern, said larger surface area enabling increased capacitive action by said DC electrode means.

8. The AC plasma display as recited in claim 7 further comprising:

conductive means connecting said DC electrode means to capacitive circuit means external to said AC plasma display, said capacitive circuit providing additional capacitive storage capacity.

9. The AC plasma display as recited in claim 7, wherein said DC electrode means and another electrode pattern that is orthogonally oriented with respect to said one electrode pattern are both supported by one of said substrates, and a dielectric layer covers said another electrode pattern but includes an aperture that exposes said DC electrode means to said ionizable gas.

10. The AC plasma display as recited in claim 7 wherein said DC electrode means is covered with an oxide that both protects said DC electrode means from sputter erosion and enables conductive communication with said ionizable gas.

11. The AC plasma display as recited in claim 1 wherein said DC electrode means comprises at least a conductive electrode oriented in orthogonal relation to electrodes of said one electrode pattern, said conductive electrode separated from said display area by a border area, said AC plasma display further comprising:

border electrode means positioned within said border area and oriented parallel to said DC electrode; and means for driving said border electrode means to create a discharge therealong when each electrode of said one electrode pattern is energized during a scan operation to create said substantially continuous gas discharge.

12. The AC plasma display as recited in claim 11, wherein said border electrode means comprise a plurality of electrodes that are energized by said means for driving to create said discharge during an address pulse time but not during a sustain pulse time.

* * * * *